US008177080B2

(12) United States Patent
Nakamitsu et al.

(10) Patent No.: US 8,177,080 B2
(45) Date of Patent: May 15, 2012

(54) GIRDER BLOCK LIFTING METHOD AND JACK-UP STAGE USED THEREFOR

(75) Inventors: Kazuhito Nakamitsu, Toshima-ku (JP); Shinichiro Takeshita, Toshima-ku (JP); Yoshimasa Kojima, Toshima-ku (JP); Jiro Yano, Toshima-ku (JP); Yuji Yokoi, Toshima-ku (JP); Shigeyoshi Kawaguchi, Toshima-ku (JP); Tetsuya Hamakawa, Toshima-ku (JP); Hironobu Tazawa, Toshima-ku (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 422 days.

(21) Appl. No.: 12/458,065

(22) Filed: Jun. 30, 2009

(65) Prior Publication Data

US 2010/0000955 A1 Jan. 7, 2010

(30) Foreign Application Priority Data

Jul. 4, 2008 (JP) ..... 2008-175569

(51) Int. Cl.
*B66C 21/00* (2006.01)

(52) U.S. Cl. ..... 212/82; 212/83; 212/97

(58) Field of Classification Search ..... 212/82, 212/83, 97

See application file for complete search history.

(56) References Cited

U.S. PATENT DOCUMENTS

| | | | | | |
|---|---|---|---|---|---|
| 3,837,503 | A | * | 9/1974 | Komatsu | 212/83 |
| 3,900,114 | A | * | 8/1975 | Inoue et al. | 212/83 |
| 3,927,535 | A | * | 12/1975 | Giblon | 405/203 |
| 4,002,321 | A | * | 1/1977 | Shaw et al. | 254/285 |
| 4,647,257 | A | * | 3/1987 | Robishaw | 405/204 |

FOREIGN PATENT DOCUMENTS

| | | |
|---|---|---|
| JP | A 8-114302 | 5/1996 |
| JP | A 11-81684 | 3/1999 |
| JP | A 11-100902 | 4/1999 |

* cited by examiner

*Primary Examiner* — Emmanuel M Marcelo
(74) *Attorney, Agent, or Firm* — Oliff & Berridge, PLC

(57) ABSTRACT

A girder block lifting method, which can solve a problem that steel beams are inclined or fallen inward by lifting a heavy material, and a jack-up stage used therefor are provided. The method includes a main beam which can be provided between steel beams being targets of connection with the girder to construct a rigid frame structure, a height adjustment means (gate-shaped base) mounted on a cross beam member being parallel to the main beam and connecting other steel frames for adjusting height to the main beam, a connection beam for alternately connecting the main beam and the height adjustment means (gate-shaped base), and an auxiliary beam for connecting the connection beams. On a frame stage formed by connecting these beams, a plurality of lifting jacks are provided and a lifting sling is hung from upper part of the steel beam to enable jack-up of the girder block.

7 Claims, 8 Drawing Sheets

GIRDER BLOCK LIFTING METHOD AND JACK-UP STAGE USED THEREFOR

BACKGROUND (a) Field of the Invention

The present invention relates to a girder block lifting method and a jack-up stage used therefor and especially relates to a girder block lifting method which is preferable when a boiler module for a thermal power plant is lifted by a girder of a steel frame for an installation work and a jack-up stage used therefor.

(b) Description of the Related Art

In a thermal power plant having a large-scale pendant boiler, steel beams of a building are set and on top edge portions of the steel beam, a girder for supporting the boiler is provided to bridge the top edge portions and to support boiler component parts by hanging. For this configuration, a lifting construction method is generally used. In this method, modules of the boiler component parts carried in the steel frame are lifted up to the girder from the ground for several tens of meters by use of a plurality of lifting jacks provided on the girder and then the modules are hung and supported from the girder by use of a sling rod or the like. Such an operation is repeatedly carried out from the module assembled on the upper part of the boiler to the module assembled on the lower part of the boiler successively to construct a boiler equipment.

To the boiler module, collateral machineries are assembled in the middle of the operation on the ground or lifting operation. However, to avoid operation in a high spot, the machineries are assembled in a condition where the module is supported by a temporary beam provided on the ground side or is hung by the lifting jack in many cases. Moreover, there is known a method to avoid hanging heavy materials at a position high from ground. According to this method, as shown in FIG. 8, girder joint portions 2 are formed in a projecting manner inside upper edge portions of a pair of beams among a plurality of provided steel beams 1 and a lifting jack 3 is installed on the upper surfaces of the girder joint portions 2. Then, a girder 4 is hung by a lifting sling 5 of the lifting jack 3 on the ground and machinery 6 to be hung from the grinder 4 is assembled by operation on the ground while the girder 4 is gradually jacked up. Such operations are repeated and when the girder 4 is finally connected to the girder joint portions 2 and fixed to the top of the steel beam 1, many of the lower boiler modules are assembled. Thus, it becomes possible to significantly reduce the amount of operation at high places. Similar construction method can be seen in the Patent Document 1. According to the document, a boiler block is hung from a girder while assembly is proceeded and finally, the girder is jacked up to a steel beam to be moved to the top edge portion of the steel beam for installation. As related inventions, techniques described in the Patent Documents 2 and 3 are also known.

[Patent Document 1] Japanese Unexamined Patent Publication No. H11-100902

[Patent Document 2] Japanese Unexamined Patent Publication No. H11-081684

[Patent Document 3] Japanese Unexamined Patent Publication No. H08-114302

However, according to the conventional construction method of hanging the module with the girder, the girder 4 is temporarily placed on the ground and is gradually hung up for several tens of meters by a lifting jack installed at the girder joint portions on the top edge portions of the steel beams while the boiler modules are assembled. Therefore, there is a problem that the steel beams would incline or collapse inward due to lifting of heavy materials. Therefore, to prevent inclination or collapse of the steel beams 1, truss-structured large frames 7 and 8 are generally constructed as projecting toward the back surface side of the steel beam in a jetty manner as shown in FIG. 8. Otherwise, as described in the Patent Document 1, a method has been adopted by which amount of inclination of the steel beam is acquired from the moment applied to the steel beam and the steel beam is inclined in the reverse direction in advance for the expected degree of inclination while the steel beam is retained by a frame so that the inclination is balanced out. Therefore, in the conventional construction method, construction equipment becomes large due to the large frames 7 and 8 for supporting the steel beam and there occurs a problem that the construction cost becomes high.

Moreover, according to the conventional method, the girder must be lifted between a pair of steel beams and joint fixed on the upper edge portions of the steel beams 1 and therefore the girder joint portions 2 are formed in a projecting manner on the inner surfaces of the upper edge portions of the steel beams 1, where the lifting jack 3 is mounted, and a lifting rod is connected to the girder for lifting. Therefore, shape of the girder joint portions 2 must be a special shape such as crossly-cut one so that a lifting rod hung from the lifting jack mounted on the upper surface of the girder joint portion 2 can be connected to the girder. Further, if the girder joint portion is shaped to have a special shape, there is a problem that the steel beam cannot be used for other construction methods using a girder which has a standard specification of other company.

SUMMARY

The present invention has been made in consideration of the above conventional problems and is aimed at providing a girder block lifting method, which enables to lift up a girder block while achieving prevention of inclination of steel beams sufficiently without constructing a large truss frame aimed at preventing inclination of the steel beams inward, and a jack-up stage used therefor in the construction of a thermal power plant. Moreover, the present invention is aimed at providing a girder block lifting method, which enables to reuse a lifting jack and other equipment without mounting the lifting jack for lifting, including hydraulic machinery, on a building such as a steel beam, and a jack-up stage used therefor.

Further, the present invention is aimed at providing a girder block lifting method, which allows the girder to be jointed with the steel beam without having a specially shaped joint portion so that the steel beam can correspond to standard-shaped girders of other manufacturers, and a jack-up stage used therefor.

To achieve the above-mentioned purposes, the girder block lifting method according to the present invention is a lifting method to hang and support heavy materials by a girder block provided between steel beams, wherein a jack-up stage where a plurality of lifting jacks are mounted is provided between tops of the steel beams for temporary connection to form a rigid frame structure with the steel beams, the girder block placed on the ground is hung for connection by a lifting sling hung from the lifting jack, the girder block is jacked up and moved while a heavy module is assembled to the girder block, and the girder block is installed onto the upper edge portions of the steel beams.

In this case, the jack-up stage may be lifted onto the top of the steel beam by a crane for temporary connection after the steel beams are constructed.

Moreover, the jack-up stage is removed after the girder block is installed to the upper edge portion of the steel beam and is reused.

Further, the jack-up stage according to the present invention includes a frame stage which can be provided between tops of the steel beams to construct a rigid frame structure with the steel beams and a plurality of lifting jacks mounted on the frame stage, wherein the girder block and the heavy module assembled thereto are enabled to be jacked up and moved by the lifting jack.

More specifically, the jack-up stage includes a main beam which is provided between steel beams which are targets of the girder connection and enabled to construct a rigid frame construction, a height adjustment means mounted on a cross beam member being parallel to the main beam and connecting the other steel beams for setting the heights to the main beam equal, a connection beam for alternately connecting the main beam and the height adjustment means, and an auxiliary beam for connecting the connection beams, wherein a plurality of lifting jacks are provided on a frame stage formed by combining these beams and the girder block is enabled to be jacked up by a lifting sling hung from the top portion of the steel beam.

In these cases, it is preferable that hanging position by the lifting jack is enabled to be adjusted by moving in a plane surface.

The present invention having the above-mentioned structure may be applied to construction of a boiler for a thermal power plant and in this case, the present invention mainly includes a method of temporarily structuring a jack-up stage where a lifting jack is provided on upper portions of steel beams without a reinforcement frame, shaping the steel beams to have the rigid frame structure, forming a girder and a pressure containing part by the lower portion, and hanging the girder to be gradually jacked up. Needless to say, the present invention is not limited to the construction of a boiler of a thermal power plant but can be applied to construction of a large building where a container is hung from a beam on the roof.

By the above-mentioned configuration, in the present invention, especially when constructing a thermal power plant, the jack-up stage constructs a rigid frame structure together with the steel beam and therefore even if the lifting weight is applied to the jack on the jack-up stage, only vertical load is applied and it becomes possible to prevent inward inclination or fall of the steel beams. Therefore, it becomes possible to lift up the girder block without constructing a large-scale truss frame for prevention of inclination or fall of the steel beam on the back surface side thereof.

Moreover, since the jack-up stage is configured to be temporarily connected to the top of the steel beam, it is not necessary to install the lifting jack or other related hydraulic machinery to the building structure including the steel beam. Therefore, it becomes possible to reuse the equipment including the lifting jack equipment in other construction sites.

In addition, since it is not necessary to form a projected stage on an inner side of the steel beams to mount a hydraulic jack, operation can be carried out without providing a specially shaped joint portion when the girder is connected to the steel beam. Therefore, it becomes possible to correspond to a girder having a standard shape of other manufacturers.

DETAILED DESCRIPTION OF EMBODIMENTS

Hereinafter, an embodiment of a girder block lifting method and a jack-up stage used therefor according to the present invention will be explained in detail based on an example where the present invention is applied to lifting of a boiler module of a thermal power plant with reference to the drawings. Here, the following embodiment is just an embodiment example and various modifications may be made without departing from the scope and spirit of the invention.

Figure 1:
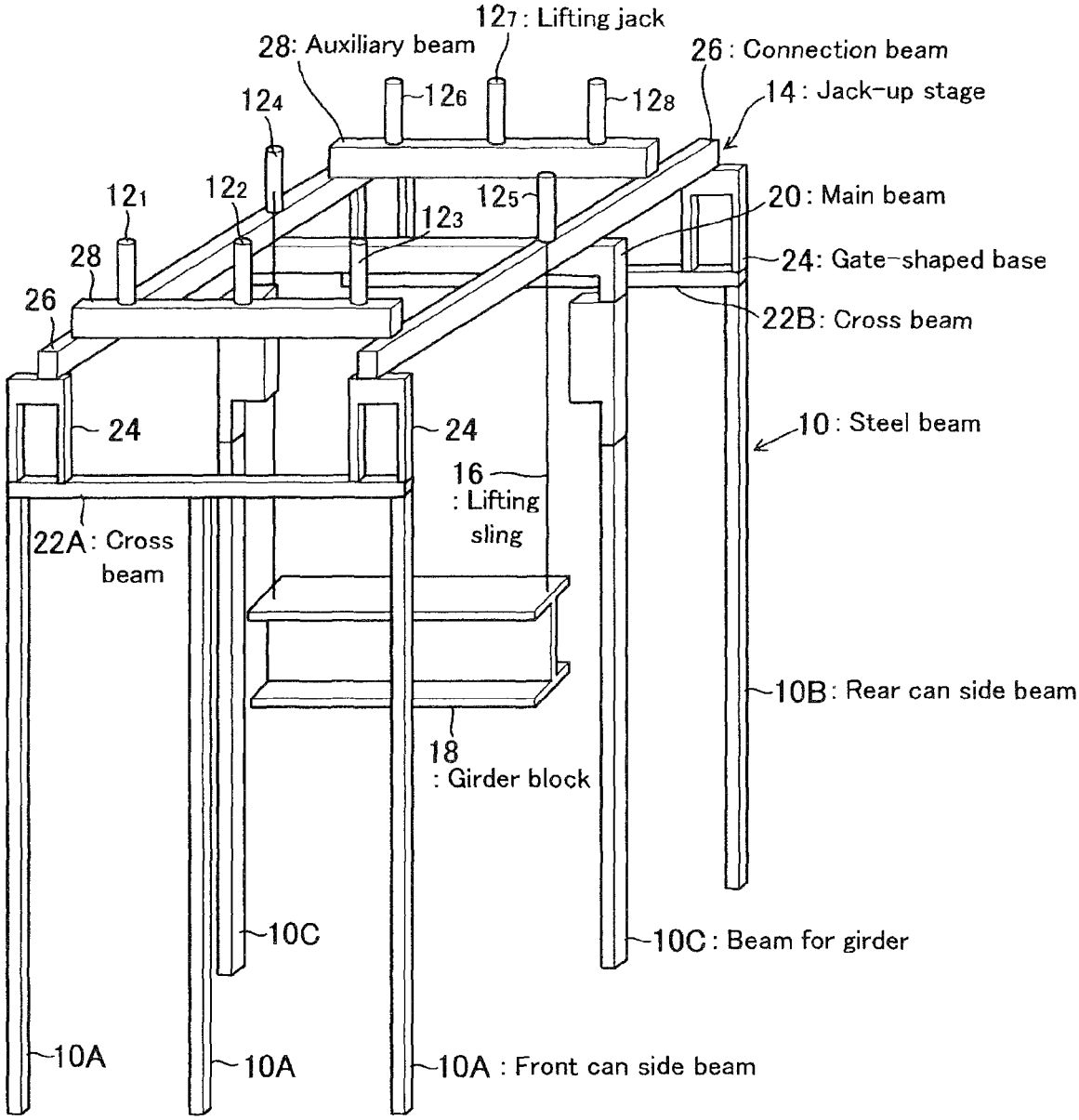
FIG. 1 A perspective view for explanation schematically showing operation condition of lifting up a girder block.

FIG. 1 is an explanatory view schematically showing a girder block lifting operation condition and is a perspective view showing a condition where a girder block which is to be lifted (a center sill block and a boiler module which is hung are omitted) is jacked up.

Figure 2:
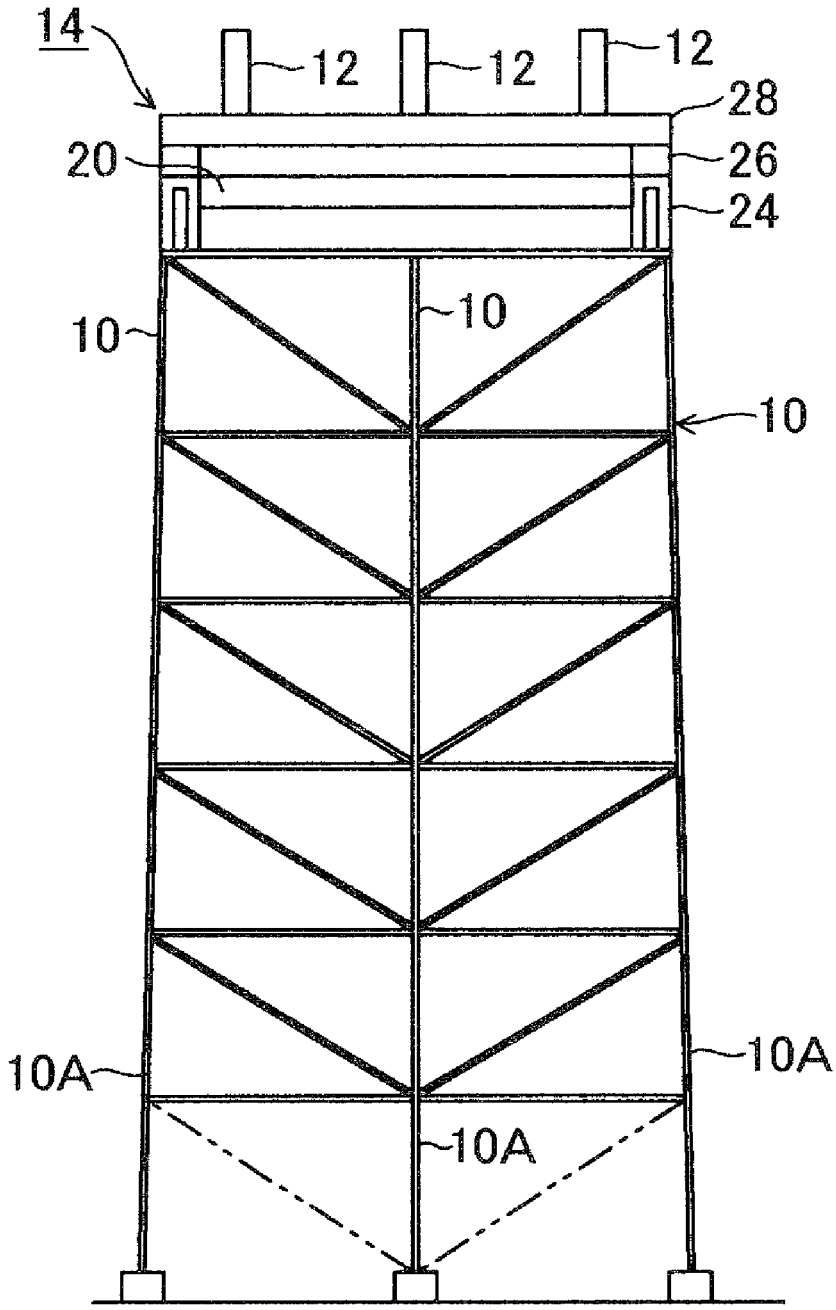
FIG. 2 An elevational view of FIG. 1.

Six steel beams 10 of building frame part of a thermal power plant are set up in advance. The steel beams 10 include three beams 10A on a front can portion side, three beams 10B on a rear can portion side, and two later-described beams for a girder 10C which are positioned in the middle of the beams 10A and 10B to be provided on building side wall side and are for attachment to the girder. Such steel beams 10 have about 60 m of height in the case of the present embodiment. Although the steel beams 10 have a cross beam truss structured construction as shown in FIG. 2 to be integrated, frames which are set in a projecting manner on rear surface side of the steel beams 10 (refer to FIG. 8) are not formed.

The construction method according to the present embodiment is to provide a jack-up stage 14, on which a plurality of lifting jacks 12 are mounted, between top portions of the steel beams 10 to be temporarily connected so that the jack-up stage 14 forms rigid frame structure with the steel beams 10 as shown in FIG. 1. Then, by use of a lifting sling 16 such as a lifting rod or a wire hung from the lifting jack 12, the girder block 18 placed on the ground side is hung and connected, the girder block 18 is jacked up and moved while a heavy module is assembled to the girder block 18, and finally the girder block 18 is placed on top edge portions of the steel beams 10.

The jack-up stage 14 includes a frame stage which can be provided between tops of the steel beams 10 to construct a rigid frame structure with the steel beams 10 and the plurality of lifting jacks 12 mounted on the frame stage. Specifically, the frame stage included in the jack-up stage 14 has a main beam 20 which is provided between the beams for a girder 10C to enable construction of the rigid frame structure. Parallel to the main beam 20, top portions between other steel beams (between the front can portion beams 10A and between the rear can portion beams 10B) are connected by cross beams 22A and 22B of the cross beam truss. Moreover, the beam for a girder 10C is formed to be higher than the front can portion side beams 10A or the rear can portion side beams 10B and as a result the beams have different height. Therefore, onto both edge portions of the cross beams 22 (22A and 22B) having lower height than the main beam 20, gate-shaped bases 24 are attached as height adjustment means so that the upper edge portions of the main beam 20 and the gate-shaped bases 24 are positioned on a same plane surface. Then a connection beams 26 for connecting the main beam 20 and the pair of gate-shaped bases 24 with adjusted height are attached on both left and right sides. The connection beams 26 are positioned to be orthogonal to the main beam 20 and the cross beam 22. Moreover, a pair of auxiliary beams 28 for connecting the pair of left and right connection beams 26 are provided in front and rear and the auxiliary beams 28 are positioned to be parallel to the main beam 20 and the cross beam 22.

Figure 3:
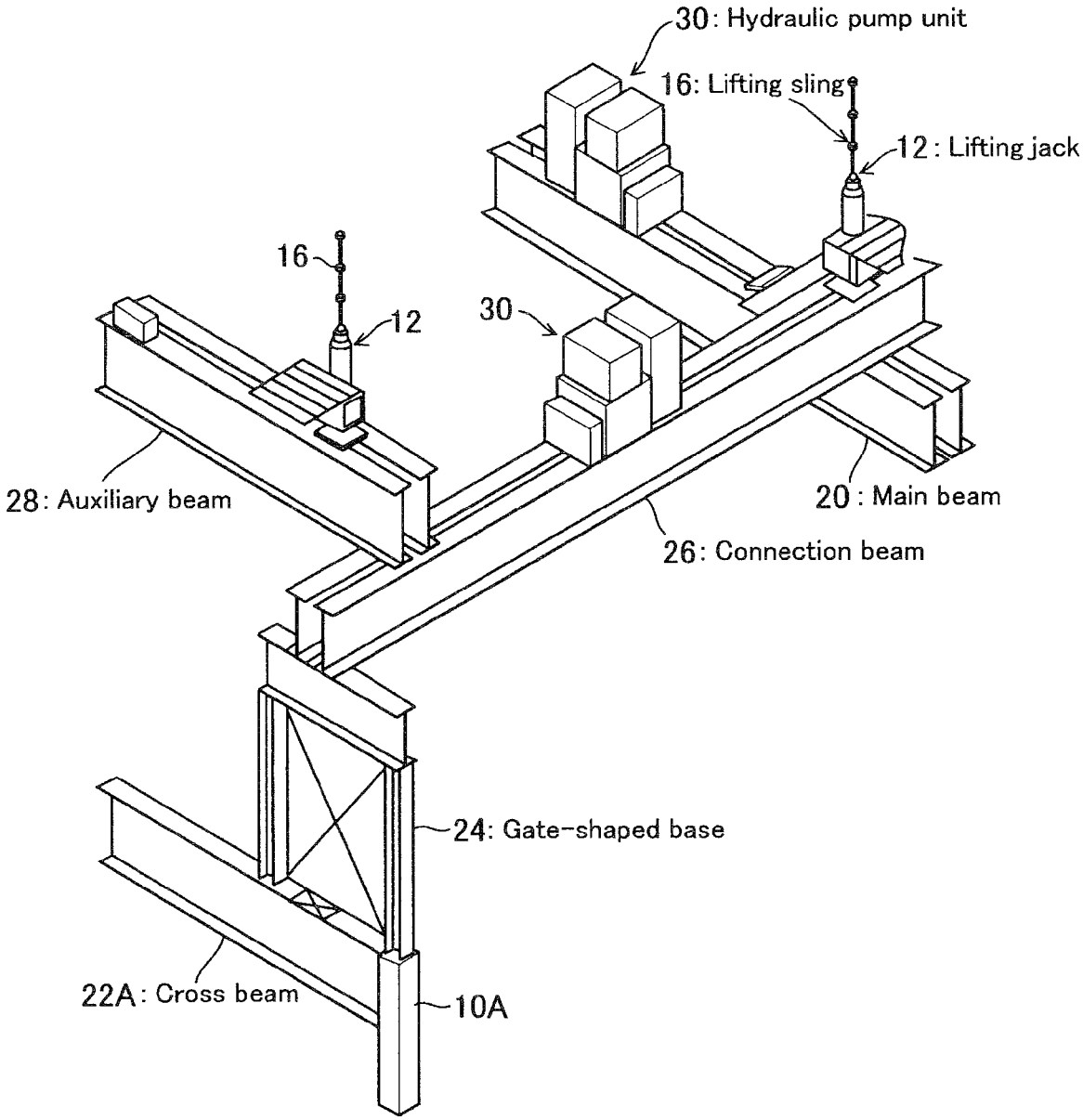
FIG. 3 A partially schematic perspective view of a jack-up stage.

Part of actual configuration of the frame stage is shown in FIG. 3. As shown in the figure, the main beam 20, the connection beam 26, and the auxiliary beam 28 of the frame stage are formed by uniting two pieces of I-shaped steel to form one beam member and a small space is provided between the two pieces of I-shaped steel so that the lifting sling 16 such as a lifting rod of the lifting jack 12 is hung through the space. Therefore, each of the lifting jacks 12 is provided on an upper surface flange portion of each of the two-piece I-shaped steel beams respectively and a hydraulic pump unit 30 which is the source of hydraulic pressure for the lifting jack 12 is also provided on the upper surface of the beam appropriately in a similar manner so that they can form one unit in an integrated manner. In the present embodiment, three lifting jacks 12 ($\mathbf{12}_1$ to $\mathbf{12}_3$, $\mathbf{12}_6$ to $\mathbf{12}_8$) are provided to the auxiliary beams 28 on the can front side and the can rear side and two lifting jacks 12 ($\mathbf{12}_4$ and $\mathbf{12}_5$) are provided on the upper surface of the connection beams 26 which are orthogonal to the main beam 20. The lifting jack 12 includes a means which causes the lifting sling 16, which is made long by screw-in connection with a small rod, to penetrate in vertical direction and makes use of a plurality of open/close chucks engaging with the neck portion of the small rod to drive the jack by the stroke of one rod so that jack-up is enabled. In other words, the lifting jack 12 includes a cylinder which is a fixed external cylinder member and a slider which is inserted therein. The cylinder has a double walled structure and the slider is stored from an upper aperture of a hydraulic room formed inside the wall body so that the slider can be elevated. At the center of such a lifting jack 12, a center hole is formed and on both edge portions of the center hole, chuck units are provided. The lifting jack 12 is driven by a hydraulic pump unit 30 and stroke of the slider and open/close of the chuck unit are controlled. Inside the center hole, the lifting sling (lifting rod) 16 is inserted and when the chuck unit is closed, the rod head part is grasped. That is, open/close of the top/bottom chuck unit is controlled and while the lifting sling 16 is grasped, stroke control of the slider is carried out so that the lifting sling 16 is elevated. Then, the lifting sling 16 is hung down through the space between two-piece I-shaped steel of each of beams 20, 26, and 28 as mentioned above, toward the ground side to support the girder block 18.

Thus, the jack-up stage 14 which is constructed by mounting the plurality of lifting jacks 12 and the hydraulic pump 30 as driving source thereof is connected and fixed to the top of the steel beam 10 in a detachable manner and is separated from the steel beam 10 after construction is over to be reused in another construction site.

Providing the above-mentioned jack-up stage 14 on the top of the steel beam 10 enables at least the beams for a girder 10C to be connected by the main beam 20 so that rigid frame structure is formed. Then, the auxiliary beam 28 enables the steel beams 10A and 10B in front and rear of can to have the rigid frame structure in a similar manner in a condition where the auxiliary beam 28 is supported by the tops of each of beams 10 and the connection beam 26 enables to form the rigid structure in the front and rear directions of the can. Thus, in a condition where the already-built jack-up stage 14 is installed, even if large amount of lifting load is applied to the steel beam 10, only vertical load is applied and therefore it is possible to prevent inward inclination or fall of the steel beams 10.

Figure 4:
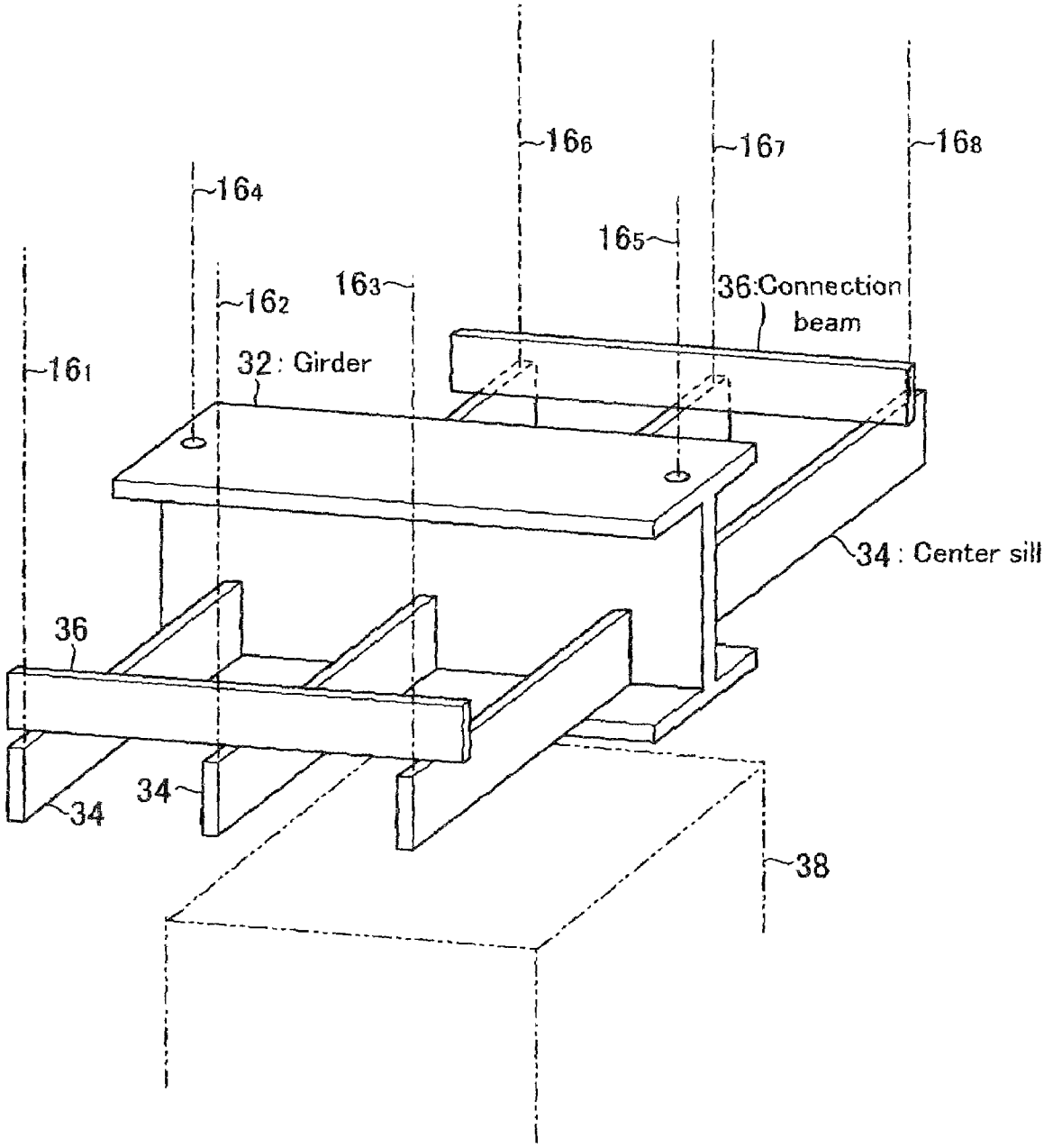
FIG. 4 A schematic pattern diagram of a girder block and a perspective view showing a condition where the girder is hung.

In a condition where the jack-up stage 14 is thus installed on the top of the steel beam 10, the girder block 18 is constructed on the ground side. The girder block 18 includes a girder 32, center sills 34 provided in an orthogonal manner to the girder 32, and connection beams 36 for connecting the center sills 34, as schematically shown in FIG. 4, and is constructed to have a shape of wisteria trellis by operation on the ground. The girder block 18 having such a configuration is lifted and supported by the lifting slings 16 ($\mathbf{16}_1$ to $\mathbf{16}_8$) which are hung from the lifting jacks 12 ($\mathbf{12}_1$ to $\mathbf{12}_8$). Then, a steam drum is assembled to the girder block 18, a plurality of sling rods are hung from the girder block 18, and boiler modules 38 such as a superheater or a reheater are assembled thereto. Subsequently, such operations are repeated and jack-up is repeated while the boiler module 38 is assembled to the girder block 18 until the girder block 18 is finally connected and fixed on the upper part of the steel beams 10.

Figure 5:
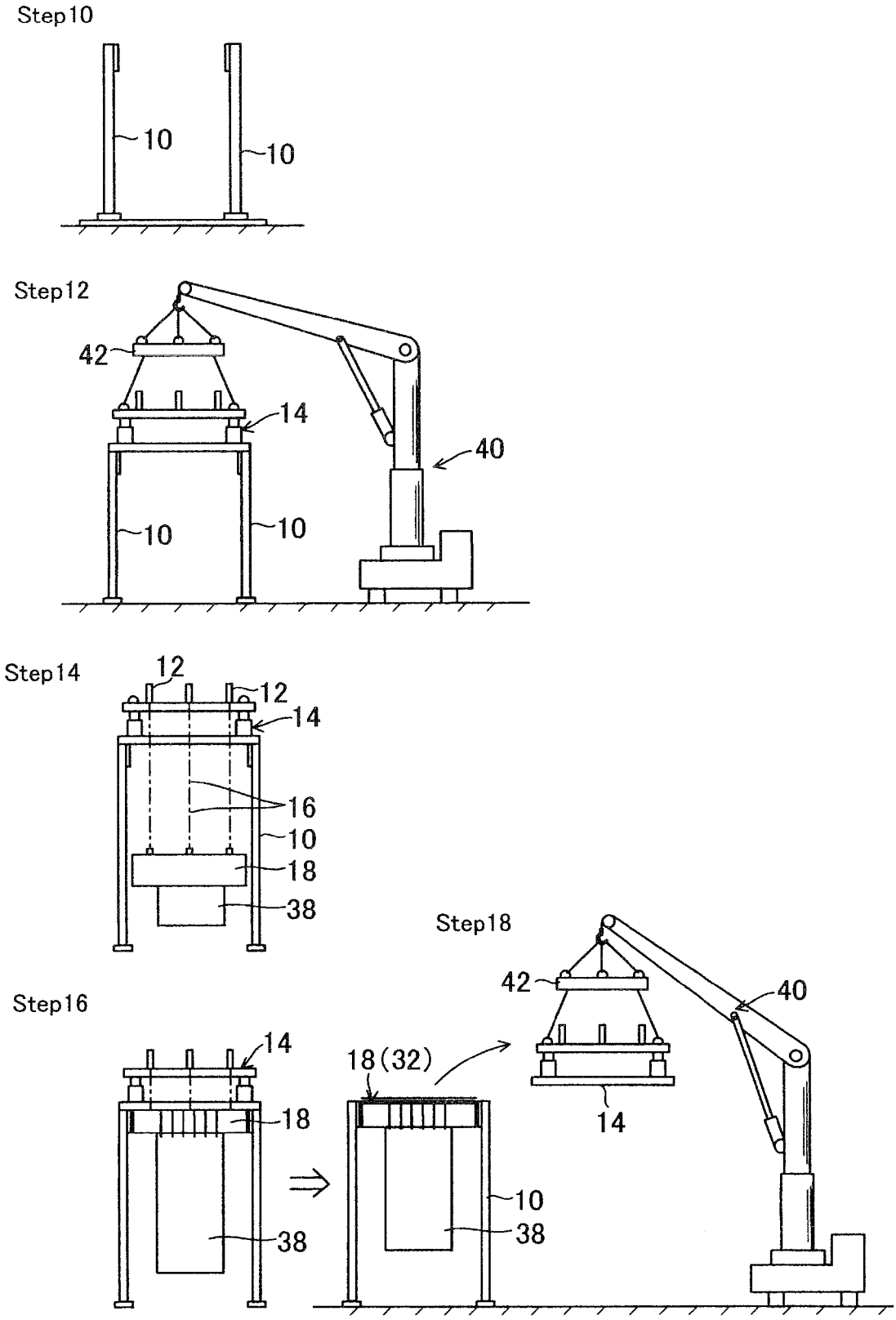
FIG. 5 A process chart showing a girder block lifting method according to the present embodiment.

FIG. 5 shows a process where the boiler module 38 is lifted together with the girder block 18 by use of the above-mentioned jack-up stage 14. First, the steel beams 10 which are frames of the thermal power plant are set (Step 10). Next, the jack-up stage 14 is lifted by a crawler crane 40 and is installed on the top of the steel beams 10 (Step 12). At this time, using pendant balance 42 enables to move the jack-up stage 14 while maintaining its levelness so that the jack-up stage 14 can be appropriately installed to the steel beams 10. Thus, a rigid frame structure by the steel beams 10 and the jack-up stage 14 is constructed to have a rigid structure.

Figure 6:
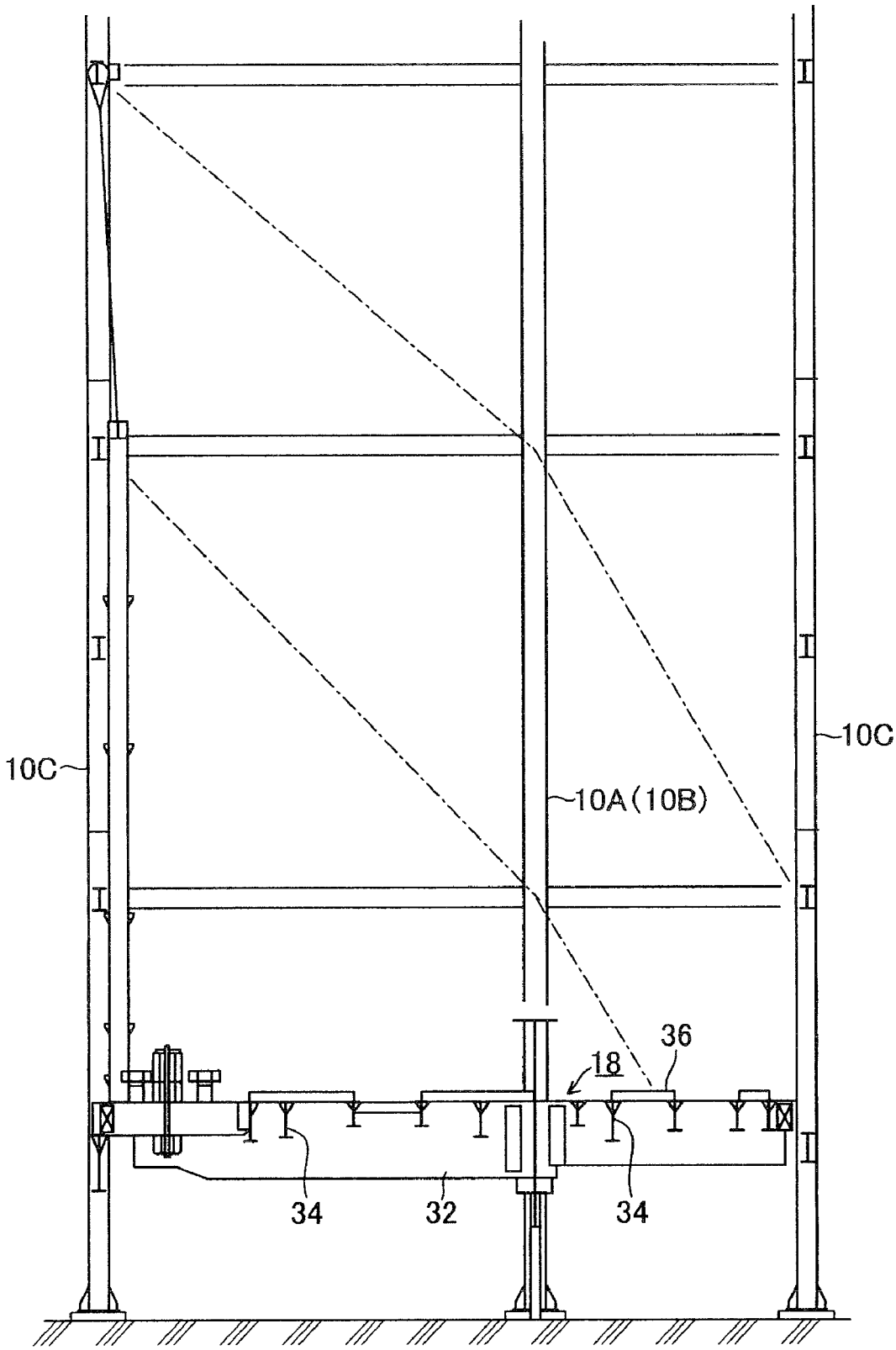
FIG. 6 An explanatory view of assembly condition of the girder block on the ground.
Figure 7:
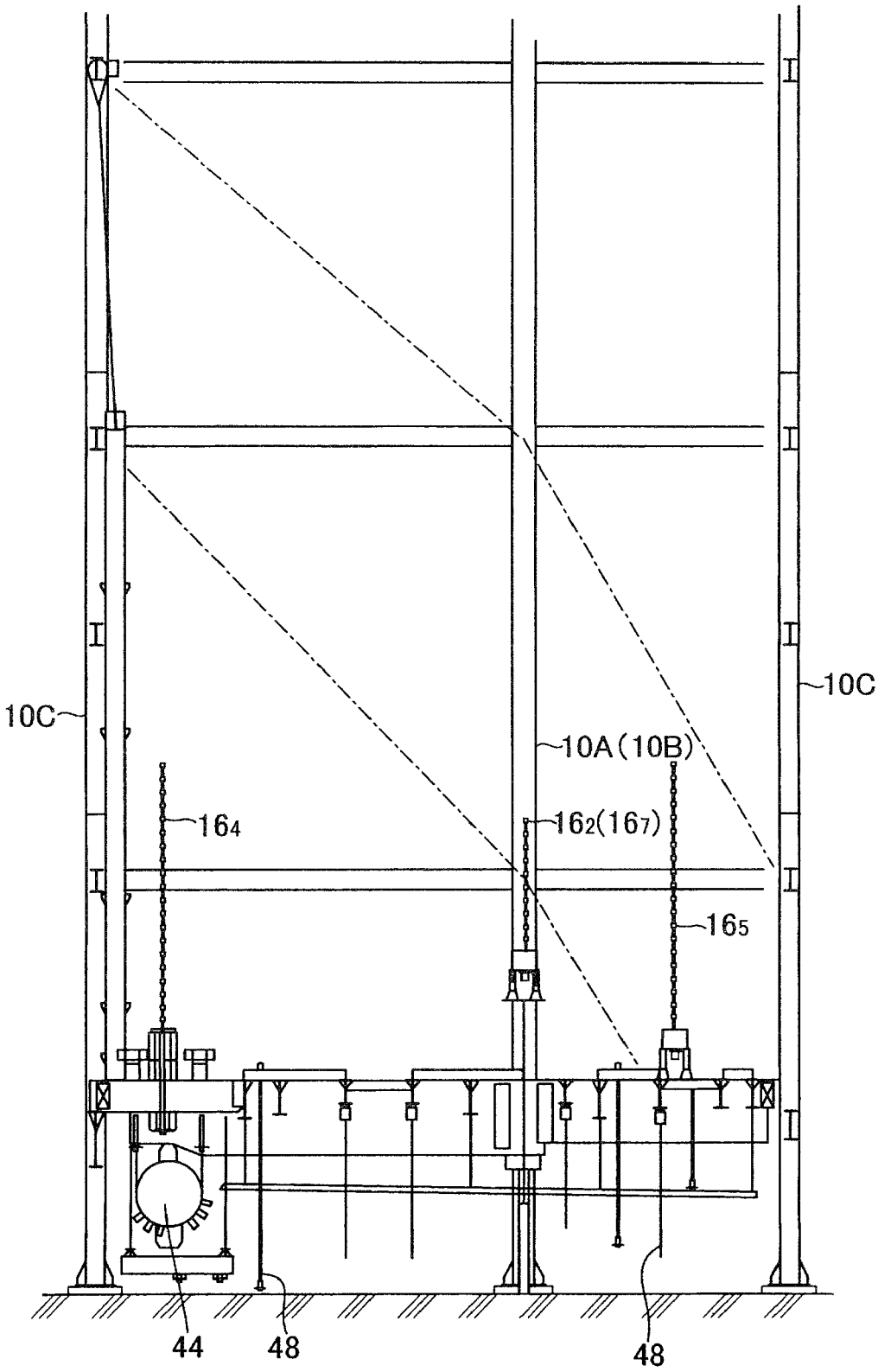
FIG. 7 An explanatory view of initial assembly condition of a boiler module to the girder block.

The girder block 18 to be lifted for operation is constructed as follows; as shown in FIG. 6, the girder 32 is temporarily jointed between the beams for a girder 10C on the ground side and the center sills 34 or the connection beams 36 are attached thereto to be integrated so that the girder block 18 shown in FIG. 4 as a schematic view is constructed. Next, as shown in FIG. 7, the steam drum 44, a sling rod 46 for hanging machinery, other ancillary equipment and the like are assembled. Simultaneously, the lifting sling 16 hung from the lifting jack 12 on the jack-up stage 14 is connected to the girder block 18. For this operation, the pendant balances are used. Thus, jack-up operation of the girder block 18 is prepared.

Subsequently, temporary joint of the girder block 18 is removed, the girder block 18 is jacked up to a predetermined height, and the boiler module 38 in lower position of the girder block 18 is assembled (Step 14) as shown in FIG. 5(*c*). While such operations are repeated, the girder block 18 is gradually lifted and finally the girder block 18 is connected to the upper edge portions of the steel beams 10 to complete lifting operation of the boiler module (Step 16).

Then, connection between the lifting jack 12 and the girder block 18 is removed and the jack-up stage 14 is removed by use of the crawler crane 40 (Step 18). The jack-up stage 14 thus removed can be transferred to another construction site and be used without any changes.

Figure 8:
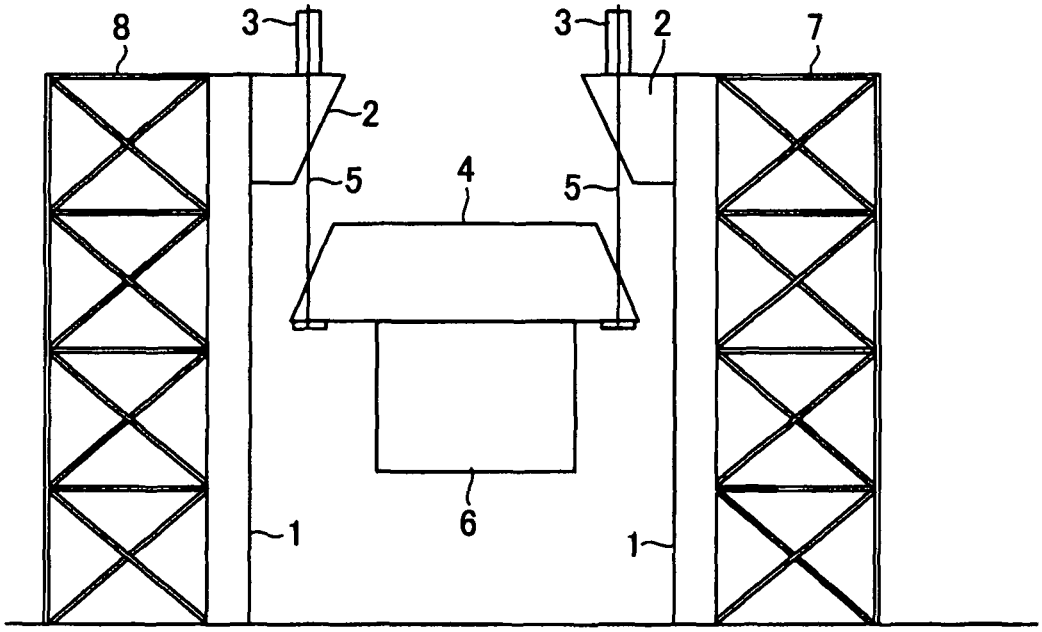
FIG.8 PRIOR ART
FIG. 8 A view for explanation of operation of a conventional girder block lifting method.

According to such an embodiment, when a thermal power plant is constructed, since the jack-up stage 14 configures a rigid frame structure with the steel beams 10, only vertical load is applied to the steel beams 10 even if lifting load is applied to the lifting jack 12 on the jack-up stage 14, and the steel beams 10 do not incline or fall inward. Therefore, it becomes possible to lift up the girder block 18 while the boiler module 38 is assembled on the girder block 18 on the ground side, without constructing a large-scale truss frame for prevention of inclination or fall of the steel beams 10 on the back surface side thereof in a projecting manner as shown in FIG. 8. Therefore, it becomes possible to reduce construction operation area and to reduce the construction cost.

Moreover, since the jack-up stage 14 is temporarily connected to the top of the steel beams 10, hydraulic equipment such as the lifting jack 12 and a hydraulic pump unit for lifting do not need to be installed on the building, including the steel beams 10. Therefore, the jack-up stage 14 including the lifting jack equipment can be reused in another site.

In addition, since it is unnecessary to form a projecting stage inside the steel beams 10 to mount a lifting jack, when the girder is mounted on the steel beams, shape of the joint portion does not need to have a special shape. Therefore, construction performance can be significantly improved and the steel beam can correspond to a girder having a standard shape of other manufacturers.

In the above-mentioned embodiment, the main beam 20, the connection beam 26, and the auxiliary beam 28 comprising the jack-up stage 14 are configured by laying one I-shaped steel on another so that the jack lifting sling 16 can be hung through a space between the two pieces of I-shaped steel. It is possible to move installation position of the lifting jack 12 by use of this space. Therefore, in a case where the girder block 18 is jacked up and there is a member connected on the steel beam 10 side, it is possible to move the girder block 18 in horizontal directions to prevent interference by such a member and to jack up the girder block. Needless to say, if a mechanism which enables the beams 20, 26, and 28 to slide is provided, horizontal movement adjustment can be more easily carried out and therefore there is an advantage that an accident between parts while operation is being carried out can be quickly avoided.

FIG. 1

1. 28: Auxiliary beam
2. 12$_7$: Lifting jack
3. 26: Connection beam
4. 14: Jack-up stage
5. 20: Main beam
6. 24: Gate-shaped base
7. 22B: Cross beam
8. 10: Steel beam
9. 22A Cross beam
10. 16: Lifting sling
11. 18: Girder block
12. 10B: Rear can side beam
13. 10C: Beam for girder
14. 10A: Front can side beam

FIG. 3

1. 30: Hydraulic pump unit
2. 16: Lifting sling
3. 12: Lifting jack
4. 28: Auxiliary beam
5. 26: Connection beam
6. 20: Main beam
7. 24: Gate-shaped base
8. 22A: Cross beam

FIG. 4

1. 32: Girder
2. 36: Connection beam
3. 34: Center sill

FIG. 5

1. Step 10

The invention claimed is:

1. A girder block lifting method to hang and support a heavy material by a girder block provided between steel beams, comprising:

mounting a jack-up stage, which comprises a plurality of lifting jacks, on tops of the steel beams, to form a temporary connection and a rigid frame structure between the steel beams and the jack-up stage;

connecting the girder block that is placed on the ground to a plurality of lifting slings hung from the plurality of lifting jacks;

jacking up the girder block while a heavy module is assembled to the girder block; and installing the girder block onto upper edge portions of the steel beams.

2. The girder block lifting method according to the claim 1, wherein the jack-up stage is lifted onto the tops of the steel beams by a crane before forming the temporary connection and after the steel beams are constructed.

3. The girder block lifting method according to the claim 1, wherein the jack-up stage is removed and reused after the girder block is installed onto the upper edge portions of the steel beams.

4. A jack-up stage comprising:

a frame stage that can be provided between tops of steel beams to construct a rigid frame structure with the steel beams; and a plurality of lifting jacks mounted on the frame stage, wherein a girder block and a heavy module assembled thereto are able to be jacked up and moved by the plurality of lifting jacks.

5. A jack-up stage comprising a main beam that can be provided between steel beams, to which a girder is to be connected, to construct a rigid frame construction;

a height adjustment means mounted on a cross beam member, which is parallel to the main beam and connects other steel beams, for setting heights of tops of the height adjustment means to be equal to a height of a top portion of the main beam;

connection beams for alternately connecting the main beam and the height adjustment means; and an auxiliary beam for connecting the connection beams, wherein a plurality of lifting jacks are provided on a frame stage formed by combining the main beam, the height adjustment means, the connection beams, and the auxiliary beam, and a girder block is able to be jacked up by a lifting sling hung from a top portion of the steel beam.

6. The jack-up stage according to claim 4, wherein a hanging position by the plurality of lifting jacks can be moved for adjustment on a plane surface.

7. The jack-up stage according to claim 5, wherein a hanging position by the plurality of lifting jacks can be moved for adjustment on a plane surface.

* * * * *